US006487966B2

(12) United States Patent
Bergomi

(10) Patent No.: US 6,487,966 B2
(45) Date of Patent: Dec. 3, 2002

(54) GRIPPER FOR CONVEYING SHEETS IN SILK-SCREEN PRINTING MACHINES

(75) Inventor: Luigi Bergomi, Cuggiono (IT)

(73) Assignee: I.S.T. S.R.L., Milan (IT)

( * ) Notice: Subject to any disclaimer, the term of this patent is extended or adjusted under 35 U.S.C. 154(b) by 0 days.

(21) Appl. No.: 09/927,497

(22) Filed: Aug. 13, 2001

(65) Prior Publication Data

US 2002/0134265 A1 Sep. 26, 2002

(30) Foreign Application Priority Data

Aug. 11, 2000 (IT) ..... MI00A1879

(51) Int. Cl.[7] ..... B41L 21/06; B41F 21/04; B65H 29/04

(52) U.S. Cl. ..... 101/408; 101/232; 101/118; 271/85; 271/204; 271/277

(58) Field of Search ..... 101/408, 415.1, 101/378, 117, 118, 232, 407.1; 271/84, 85, 204, 206, 268, 277

(56) References Cited

U.S. PATENT DOCUMENTS 2,984,178 A 5/1961 Koch ..... 101/409
3,924,849 A 12/1975 Murakami ..... 271/204
4,526,100 A 7/1985 Brasa ..... 101/408
5,128,726 A * 7/1992 Cassano et al. ..... 271/204
5,393,047 A * 2/1995 Ahl et al. ..... 271/204

* cited by examiner

*Primary Examiner*—Leslie J. Evanisko
(74) *Attorney, Agent, or Firm*—Young & Thompson

(57) ABSTRACT

A gripping device for conveying sheets in silk-screen printing machines. The gripping device comprises a box-like gripping bar having an outwardly and upwardly slanted rear wall provided with a longitudinally extending stepped edge at the upper side for resting a sheet; a plurality of tiltable plate-like gripping elements, forming a flat jaw, are disposed side by side and hinged to the side edge of the gripping bar which is opposite to the slanted wall. A corresponding number of lifting arms for tilting the gripping plates are secured to a drive shaft which extends into a tubular portion of the box-like gripping bar; the gripping bar is provided at both ends carriages and control levers to cause rotation of the lifting arms and tilting of the gripping plates, against the action of biasing springs during running on the printing machine. This solution provides a wide gripping surface for the sheets, reduces specific pressures, and a gripper with a simplified design.

2 Claims, 2 Drawing Sheets

GRIPPER FOR CONVEYING SHEETS IN SILK-SCREEN PRINTING MACHINES

BACKGROUND OF THE INVENTION

This invention refers to a gripping device for gripping and transporting sheets in single or multicolor silk screen printing machines, and in particular is directed to a gripper for conveying sheets in silk-screen printing machines of the type in which the gripper is supported by carriages and moved along a printing surface above silk-screen printing panels, to bring the individual sheets to be printed in line with the various work stations.

A gripper of the type referred to, in general comprises an elongated bar provided with gripping jaws which can be opened to allow the insertion of a sheet to be printed, and the removal of a printed sheet, and closed to retain a sheet. The gripper is normally supported at both ends by carriages connected to driving chains which run along lateral guides of the printing machine.

Grippers for printing machines are shown for example in U.S. Pat. No. 2.984.178, U.S. Pat. No. 3.924.849 and U.S. Pat. No. 4.526.100.

Grippers of this kind present several drawbacks and prove to be somewhat unsuitable in that they do not always allow to properly grip the sheets, and in addition tend to generate high gripping forces which are liable to pierce or damage the gripped sheet.

In order to partially obviate these drawbacks, U.S. Pat. No. 4.526.100 proposes a gripper device comprising a box-like supporting body provided with a flat jaw and a plurality of plate-like gripper elements set in mutual alignment for oscillation in respect to said juxtaposed flat jaw, by means of sliding elements which are reciprocated by a drive shaft of the silk screen printing machine. A gripper of this kind presents extremely complex structure and configuration, which will tend to generate excessively high gripping forces, which in certain cases may even piercing and damage the sheets.

The main object of this invention is to provide a gripper for conveying sheets in silk-screen printing machines, which is of innovative design and such as to obviate the aforementioned drawbacks.

In particular, one object of this invention is to provide a gripper of the above-mentioned type, which provides a wide contact surface for gripping the sheets, thereby reducing the specific contact pressures.

A still further object of this invention is to provide a gripper as mentioned above, which is extremely simple in design and can be manufactured from an extruded structural section with extremely inexpensive costs.

BRIEF DESCRIPTION OF THE INVENTION

The above can be achieved by means of a gripping device for gripping and conveying sheets in single and multicolor silk-screen printing machines, comprising:

- a box-like gripping bar having an upwardly and outwardly slanted rear wall provided with a longitudinally extending stepped edge having an upper sheet-gripping surface;
- a plurality of side by side arranged plate-like gripping members, hingedly connected to the gripping bar to define a flat jaw;
- preloaded spring members to bias each of said gripping members against the sheet gripping surface of said stepped edge of the gripping bar;

- a plurality of lifting arms for said plate-like gripping members, operatively connected to a reciprocating drive shaft;
- an actuating lever at each end of the drive shaft, to reciprocate the same and tiltably move said gripping members for gripping and releasing a sheet; and
- carriage means at each end of box-like to run the gripping device along slide guides of the printing machine.

BRIEF DESCRIPTION OF THE DRAWINGS

These and further features of the gripper for silks-screen printing machines according to the invention, will be more clearly evident from the following description with reference to the accompanying drawings, in which.

DETAILED DESCRIPTION OF THE INVENTION

Figure 1:
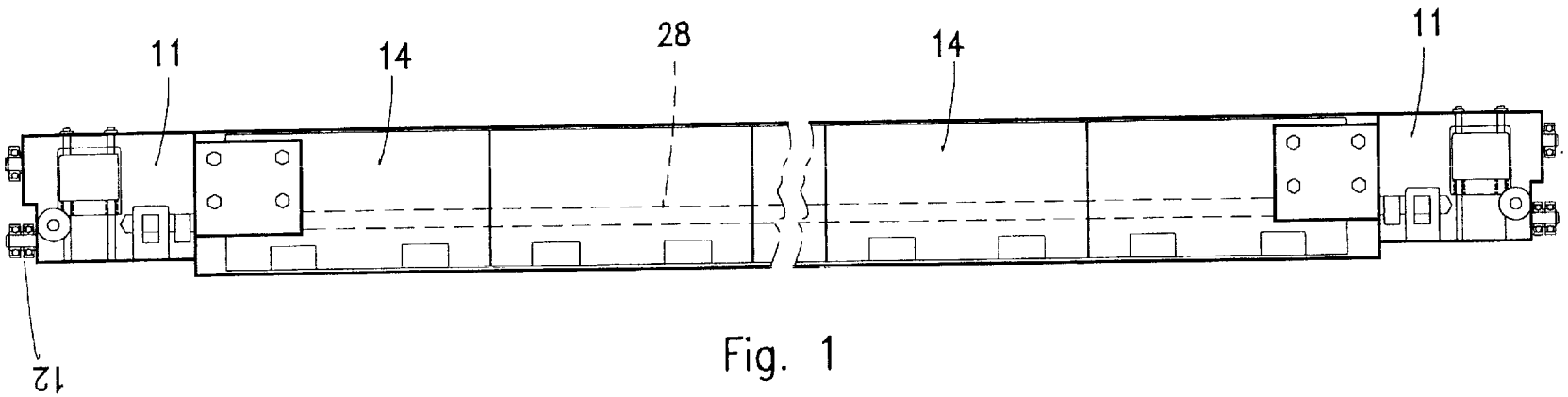
FIG. 1 is a top view of the gripper.
Figure 2:
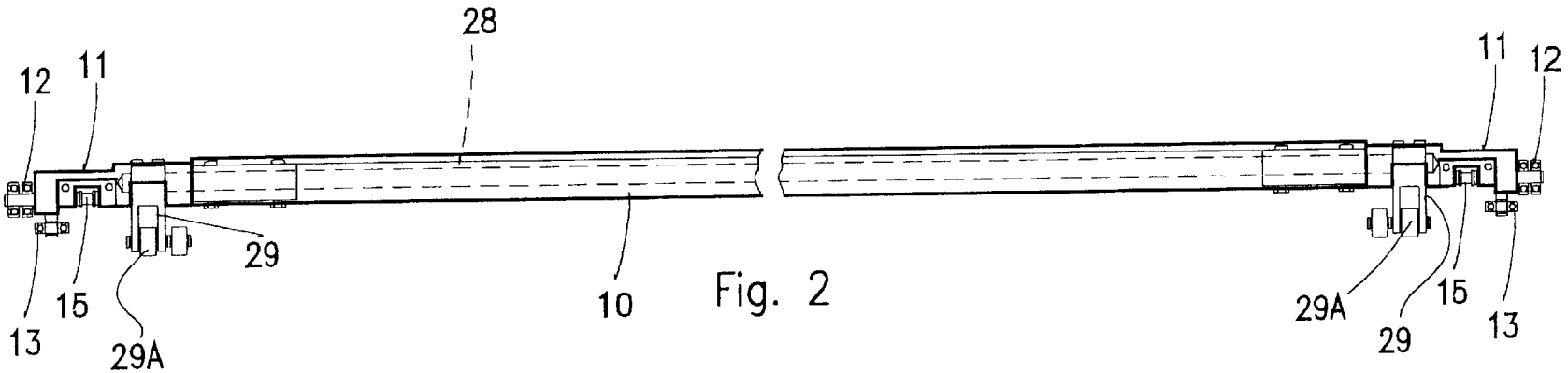
FIG. 2 is a front view of the gripper of FIG. 1.

As shown in the various figures, the gripper substantially comprises a gripping bar having an elongated box-like body 10, for example an aluminium structural section, supported at each end by a carriage 11 provided with rollers 12 and 13 running along slide guides which extend along a printing surface of a silk-screen printing machine.

On the box-like body 10 of the gripping bar, a plurality of tiltable plate-like gripping members 14 for gripping a sheet, are provided in side by side arrangement to form a flat jaw hingedly connected to a side edge of box-like body 10 of the same gripping bar.

The carriages 11 are connected to drawing chains 15 for moving the gripper along a work path on a single or multicolor silk-screen printing machine.

Figure 3:
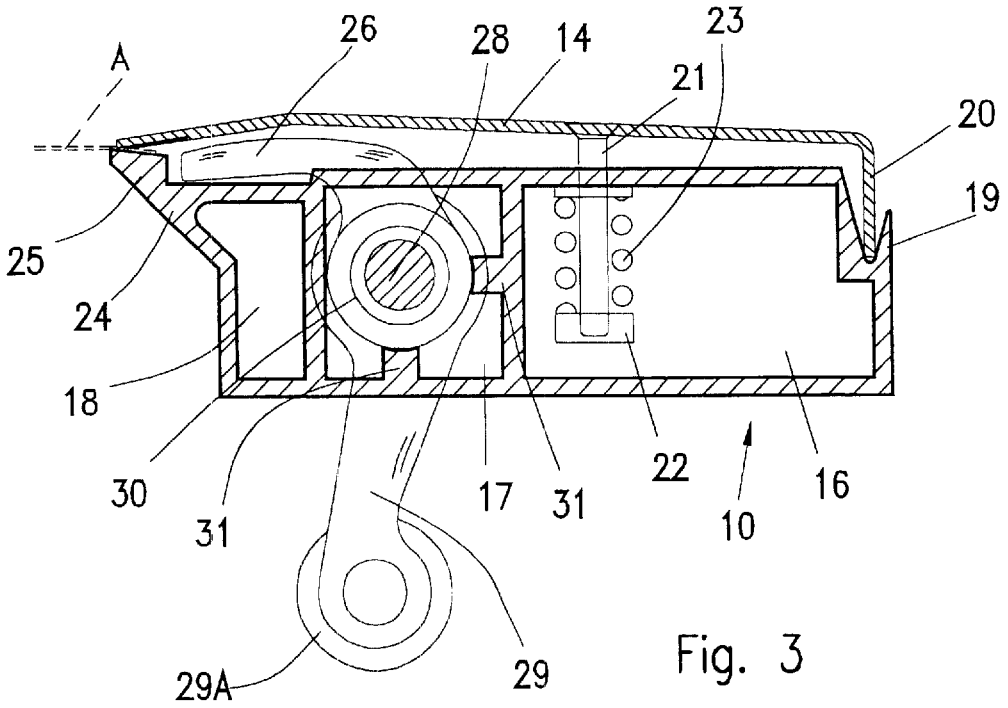
FIG. 3 shows an enlarged cross-sectional view of the gripper in the closed condition.
Figure 4:
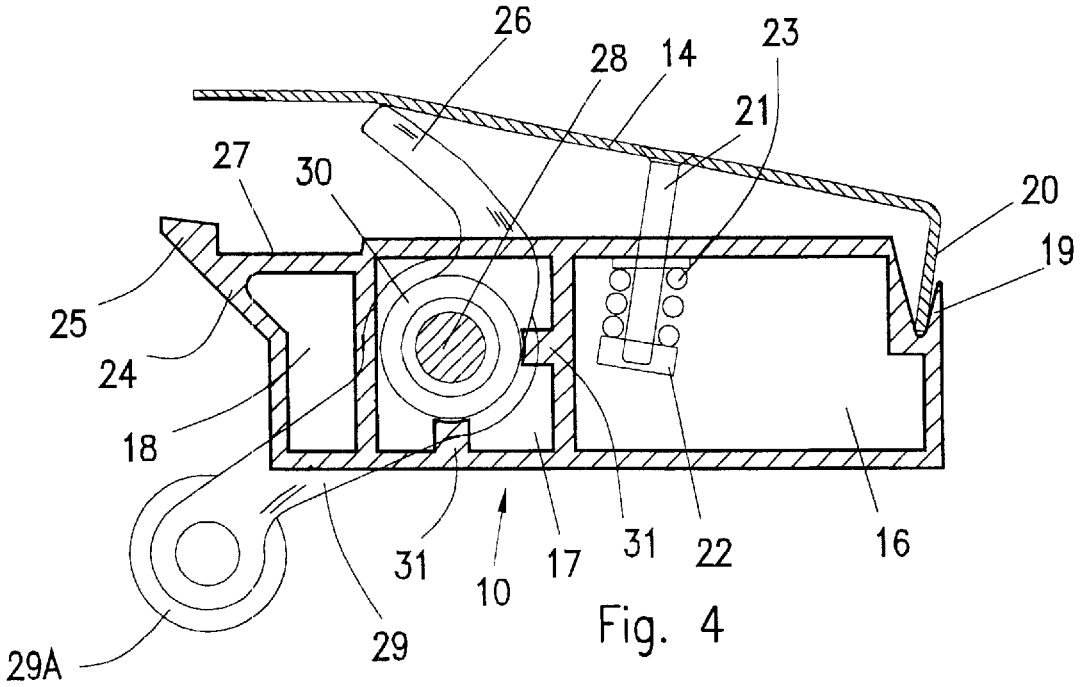
FIG. 4 shows an enlarged cross-sectional view of the gripper in the open condition.

More precisely, as shown in the enlarged cross-sectional views of FIGS. 3 and 4, the box-like body 10 of the bar comprises three tubular portions 16, 17 and 18 of which the tubular portion 16 presents, at the outer-side, is provided with a longitudinal V-shaped groove 19 into which is hingedly disposed a downwardly folded edge 20 of each gripping member 14.

Each gripping member 14 co-operates with a stepped edge 25 on the other side of the tubular body 10 to grip a sheet A onto which a pattern and/or a wording is to be printed. Each gripping member 14 is also provided with a downwardly oriented pin 21 which penetrates a through-hole in the upper wall of the tubular portion 16 of the bar; the pin 21 is provided at its lower end with an enlarged head 22 to hold a pre-loaded spring 23 designed to bias each plate-like gripping member 14 to the closed position of FIG. 3, against the upper flat surface of the stepped edge 25 along the rear side of the gripping bar 10.

In turn, the tubular portion 18 of the gripping bar 10 is provided on the outer side, with a slanted wall 24 which extends outwardly and upwardly into the stepped edge 25 having a wide flat upper surface for gripping the sheet A.

The tilting or reciprocating movement of the plate-like gripping members 14 is achieved by means of respective L-shaped arms 26 which extend from the inside of the bar 10, through cross-wise slots and towards the stepped edge 25; in the closed position of the gripper, shown in FIG. 3, the lifting arms 26 are housed inside a longitudinal cavity 27 slightly lowered compared to the upper wall of the bar 10, in correspondence with the tubular portion 18.

The lifting arms 26 for the gripping members 14 are connected to a drive shaft 28 which extends longitudinally to the gripper and which, in correspondence with each carriage 11, presents a control lever 29 provided with rollers 29A; during the working stroke of the gripper, the rollers 29A run on cams or slanted surfaces which cause rotation of the drive shaft 28 and levers 29 for conjointly lifting or tilting up the gripping members 14, against the action of the biasing springs 23.

Again, with reference to FIGS. 3 and 4, it can be seen that the drive shaft 28 is supported by means of bearings 30 inside the intermediate tubular portion 17 of the bar 10; the bearings 30 are held in place by longitudinal ribs 31, designed to constitute also stiffening means for the bar, on two adjacent walls of the intermediate tubular section 17.

From what has been described and shown in the accompanying drawings it will be understood that a gripper for silk-screen printing machines, both of multicolor and in black and white or single type, has been provided having such an extremely simplified structure and design.

In fact, a gripper of this kind offers a very large gripping surface for gripping sheets, which reduces specific pressures, thereby reducing the risk of damaging the sheets to a minimum; moreover, due to the greater lateral extension or width of the gripper, as compared to conventional ones, it is possible to operate with smaller spring-loads, thus enabling the gripper to open and close very gently, and reducing the causes of wear and noise.

What we claim is:

1. A gripping device for gripping and conveying sheets in a single or multicolor silk-screen printing machine, comprising:

a box shaped gripping bar having an upwardly and outwardly slanted rear wall provided with a longitudinally extending stepped edge having an upper sheet-gripping surface;

a plurality of side by side arranged plate shaped gripping members, hingedly connected to the gripping bar to define a flat jaw;

preloaded spring members to bias each of said gripping members against the sheet gripping surface of said stepped edge of the gripping bar;

a plurality of lifting arms for said plate shaped gripping members;

a reciprocating drive shaft operatively connected to the plurality of lifting arms;

an actuating lever at each end of the drive shaft, to reciprocate the drive shaft and tiltably move said gripping members for gripping and releasing a sheet; and carriage means at each end of box shaped gripping bar adapted to run the gripping device along slide guides of the printing machine, wherein the body of said box shaped bar comprises an intermediate tubular portion provided with stiffening ribs to retain bearings for supporting the drive shaft.

2. The gripping device according to claim 1, wherein the upper wall of the box shaped bar, comprises a cavity for housing said lifting arms, said cavity longitudinally extending to the body of the gripping bar, on a side of the stepped edge.

* * * * *